US010232862B2

(12) United States Patent
Landrum et al.

(10) Patent No.: US 10,232,862 B2
(45) Date of Patent: Mar. 19, 2019

(54) SADDLE SYSTEM FOR USE IN THE RAIL TRANSPORT OF LARGE TOWERS

(71) Applicants: Scott C. Landrum, Southlake, TX (US); T. Christopher King, Keller, TX (US); Jamie V. Johnson, Euless, TX (US)

(72) Inventors: Scott C. Landrum, Southlake, TX (US); T. Christopher King, Keller, TX (US); Jamie V. Johnson, Euless, TX (US)

(73) Assignee: BNSF Logistics, LLC, Springdale, AR (US)

( * ) Notice: Subject to any disclaimer, the term of this patent is extended or adjusted under 35 U.S.C. 154(b) by 162 days.

(21) Appl. No.: 15/410,964

(22) Filed: Jan. 20, 2017

(65) Prior Publication Data

US 2017/0210395 A1 Jul. 27, 2017

Related U.S. Application Data

(60) Provisional application No. 62/287,032, filed on Jan. 26, 2016.

(51) Int. Cl.
*B61D 3/16* (2006.01)
*B61D 45/00* (2006.01)

(52) U.S. Cl.
CPC ..... *B61D 3/166* (2013.01); *B61D 45/003* (2013.01)

(58) Field of Classification Search
CPC ..... B61D 3/166; B61D 45/003
See application file for complete search history.

(56) References Cited

U.S. PATENT DOCUMENTS

| | | | | | |
|---|---|---|---|---|---|
| 3,071,269 | A * | 1/1963 | Moulds, Jr. | B65D 19/44 | 108/55.3 |
| 3,430,407 | A | 3/1969 | Berry | | |
| 3,648,622 | A | 3/1972 | Lich | | |
| 3,837,295 | A | 9/1974 | Fedele | | |
| 3,922,004 | A * | 11/1975 | Chamberlain | B60P 3/035 | 410/49 |
| 4,102,274 | A * | 7/1978 | Feary | B60P 3/035 | 410/102 |
| 4,150,628 | A | 4/1979 | Keldenich | | |
| 4,341,494 | A | 7/1982 | Fedele | | |
| 4,365,919 | A | 12/1982 | Mehki | | |
| 4,375,860 | A | 3/1983 | Greaves, Jr. | | |
| 4,844,672 | A | 7/1989 | Yurgevich | | |
| 5,114,288 | A | 5/1992 | Langendorf et al. | | |
| 5,425,608 | A * | 6/1995 | Reitnouer | B60P 7/12 | 410/49 |
| 5,562,390 | A | 10/1996 | Christenson | | |
| 5,579,698 | A * | 12/1996 | Lis | B61D 3/16 | 105/176 |

(Continued)

*Primary Examiner* — Jason C Smith
(74) *Attorney, Agent, or Firm* — Dan Brown Law Office; Daniel R. Brown

(57) ABSTRACT

A saddle and foot stop mounting system for large tower sections transported by rail. A locating assembly, including a key rail assembly and a foot stop assembly are used in conjunction with movable saddles. The foot stop assembly includes a locating key for engaging one of plural key fixtures along the key rail, which defines plural mounting locations for the foot stop. Used in conjunction with the movable saddles, this system accommodates a wide range of tower section sizes and weights.

17 Claims, 5 Drawing Sheets

(56) References Cited

U.S. PATENT DOCUMENTS 5,802,981 A 9/1998 Kassab
6,286,435 B1 9/2001 Kassab et al.
6,398,047 B1 6/2002 Ladendorf et al.
6,422,795 B2 7/2002 Holt et al.
6,546,878 B1 4/2003 Smith et al.
6,827,024 B2 12/2004 Kassab et al.
7,210,882 B2 5/2007 Anderson et al.
7,244,084 B2 * 7/2007 Anthony ..... B60P 7/12 410/36
7,303,365 B2 12/2007 Wobben
7,429,156 B2 9/2008 Jensen
8,142,120 B2 * 3/2012 Landrum ..... B61D 3/166 410/44
8,491,239 B2 * 7/2013 Ferrari ..... B60P 7/12 410/30
8,500,378 B1 * 8/2013 Landrum ..... B60P 3/40 410/44
8,529,174 B1 * 9/2013 Landrum ..... B60P 3/40 410/44
9,683,546 B1 * 6/2017 Keller ..... F03D 13/40
2004/0091346 A1 5/2004 Wobben
2005/0031431 A1 * 2/2005 Wobben ..... B60P 3/40 410/45
2005/0063795 A1 * 3/2005 Jagos ..... B60P 3/11 410/49
2006/0285937 A1 12/2006 Wobben
2007/0036627 A1 * 2/2007 Wright ..... B25H 1/0007 410/49
2007/0051270 A1 3/2007 Forbes et al.
2007/0177954 A1 * 8/2007 Kootstra ..... B60P 3/40 410/44
2007/0189895 A1 8/2007 Kootstra et al.
2007/0248431 A1 * 10/2007 Jensen ..... B60P 3/40 410/45
2008/0213059 A1 9/2008 Wright et al.
2008/0272075 A1 * 11/2008 DeMent ..... B60P 7/12 211/85.5
2009/0169323 A1 * 7/2009 Livingston ..... F03D 1/0675 410/120
2017/0210395 A1 * 7/2017 Landrum ..... B61D 45/003

* cited by examiner

Section A-A

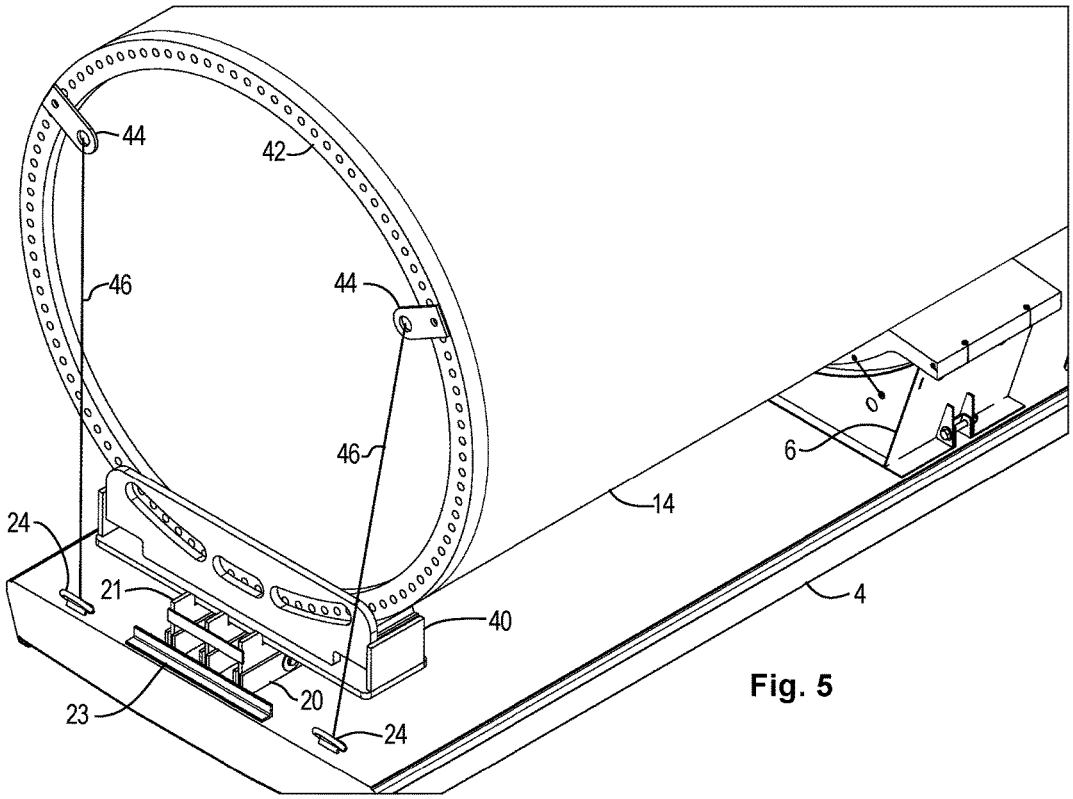
Fig. 5
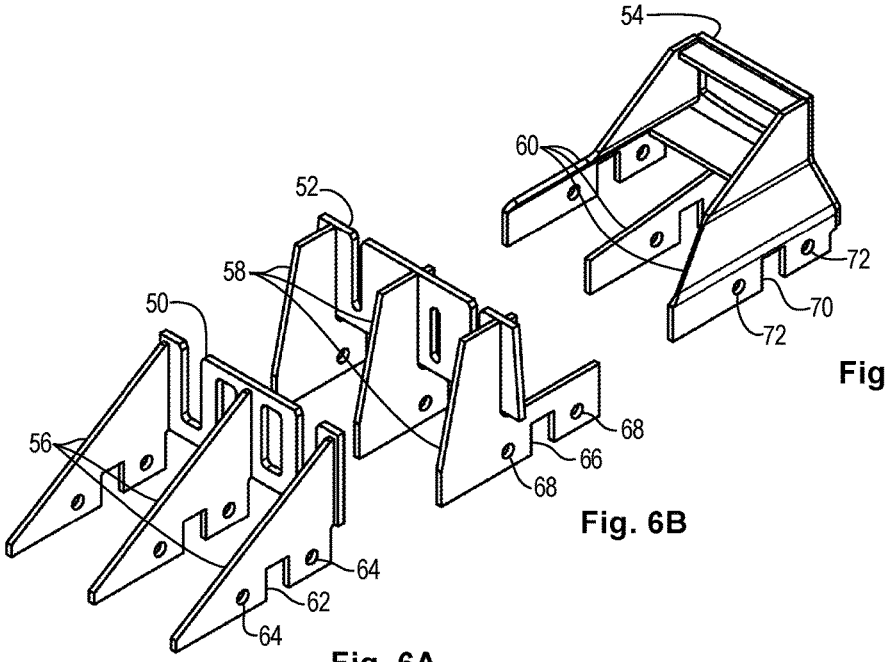
Fig. 6C
Fig. 6B
Fig. 6A

Section B-B

Section C-C

SADDLE SYSTEM FOR USE IN THE RAIL TRANSPORT OF LARGE TOWERS

RELATED APPLICATIONS

This application claims priority to U.S. provisional application Ser. No. 62/287,032, which was filed on Jan. 26, 2016.

BACKGROUND OF THE INVENTION

Field of the Invention

The present invention relates to transporting large towers by railroad. More specifically, the present invention relates to a system and method for transporting large towers and tower sections, such as towers used to support commercial wind turbines, using adjustable position fixtures to accommodate tower sections of various lengths and weight profiles.

Description of the Related Art

Large-scale wind turbines are used to generate electrical power. Such wind turbines consist of a tall tower with a generator nacelle rotatably coupled about the top of tower's vertical axis. A rotor hub extends out a horizontal axis of the nacelle. Two or more turbine blades are connected to the rotor hub at right angles to the horizontal axis. During operation, prevailing winds cause the turbine blades to rotate about the rotor hub's horizontal axis. The rotational forces are coupled to a generator within the nacelle, which produces electricity. The nacelle rotates about the vertical axis of the tower to maintain the wind turbine blades in proper orientation to the direction of the prevailing winds.

The various components of a large-scale wind turbine may be manufactured at different geographic locations, which may be anywhere in the world. These components must then be transported to the ultimate power generation site, assembled, erected, and placed into operation. Since the manufacturing operations may be spread across the world, transportation of the components to the generation site may utilize all modes of transportation, including ships, barges, trains and trucks. The various components are expensive to manufacture, and include delicate components that must be protected and handled properly during transportation. The transportation issues are exacerbated in that the components may be transported using plural modes during their journey. For example, a wind turbine tower manufactured in Denmark may travel by ship across the ocean, then via railroad to a location in the geographic area of the generation site, and then finally by truck to the ultimate destination. Mounting fixtures are needed to adapt the particular component being transported to each mode of transportation.

Generally, longer rail flatcars are preferred for transpiration of towers and tower sections. Presently, the inventory of 89-foot long flatcars in the railroad industry is declining, while the usage demand for these cars is increasing, particularly with regards to the transport of wind turbine tower sections. Given this constraint, users are demanding systems that allow for the quick reconfiguration of the available flatcars, as needed to transport wind turbine tower sections of varying length. Reconfiguration is desirable because this limited fleet of rail assets must be used for a variety of towers and tower sections that may have various lengths and weight distribution profiles, and which must be loaded onto the railcars in a manner that satisfies the design criteria of the railcars. Fixed saddle systems for the railcar transport of wind turbine tower sections are shown in co-assigned U.S. Pat. No. 8,529,174, which is incorporated herein by reference for all purposes. Thus it can be appreciated that there is a need in the art for a system and method addressing the problems related to transportation of long and heavy towers and tower sections via rail.

SUMMARY OF THE INVENTION

The need in the art is addressed by the systems and methods of the present invention. The present disclosure teaches a system for transporting tower sections of various lengths and weight profiles on railcars that have a deck, wherein the tower sections have a first end and an elongated portion. The system includes a locating assembly, which includes a key rail assembly and a foot stop assembly. The foot stop assembly includes a locating key and is adapted for rigid attachment to the first end of the tower section. The key rail assembly is adapted for rigid attachment to the railcar deck, and includes plural key fixtures along its length for selective engagement with the locating key, which define plural mounting locations along the length of the railcar at which the foot stop assembly may be located. A saddle assembly is configured to rest upon the deck of the railcar at a location along the elongated portion of the tower section, and has a saddle that generally conforms to the circumference of the tower section. The locating assembly and the saddle assembly cooperatively support the tower section above the deck of the railcar.

In a specific embodiment, the foregoing system further includes plural deck brackets that are adapted for fixed connection to the railcar deck, such as by welding. In this embodiment, the saddle assembly further includes at a least one attachment gusset configured to selectively engage any of the plural deck brackets. The plural deck brackets are fixedly connected to the railcar deck and longitudinally spaced such that the location of the saddle assembly is adjustable along the longitudinal axis of the tower section.

In a specific embodiment of the foregoing system, the locating key and the plural key fixtures are implemented to engage one another with cooperative slots and bars. In another specific embodiment, the key rail assembly includes at least a first steel rail, and the plural key fixtures are plural longitudinally spaced transverse slots formed in the rail. The locating key includes a transverse steel bar sized to retainably engage any of the plural longitudinally spaced transverse slots.

In a specific embodiment of the foregoing system, the key rail assembly includes at least two parallel rails, and the plural key fixtures are plural longitudinally spaced transverse bars connected between the rails. The locating key includes a transverse slot formed in the foot stop that is sized to retainably engage any of plural longitudinally spaced transverse bars.

In a specific embodiment of the foregoing system, the key rail assembly includes plural holes formed though it, which correspond with the plural mounting locations. The foot stop assembly includes at least a first pin hole. This embodiment further includes at least a first locating pin disposed between the first pin hole and at least one of the plural holes formed in the key rail assembly, to thereby lock the foot stop assembly at one of the plural mounting locations on the key rail assembly.

In a specific embodiment of the foregoing system, the key rail assembly is welded to the deck of the railcar and the foot stop assembly is bolted to the first end of the tower section.

In a specific embodiment of the foregoing system, the tower section includes a mount attached to the first end. The foot stop assembly further includes a mount engagement means configured to engage the mount to resist movement along the longitudinal axis of the railcar, and resist rotation of the tower section. In a refinement to this embodiment, where the mount includes a horizontal support surface, the system further provides that the mount engagement means is a recess formed in the top of the foot stop assembly that is shaped to partially conform to the shape of the horizontal support surface.

In a specific embodiment, the foregoing system further include a first group of plural deck brackets fixed to the railcar deck and longitudinally spaced apart. The saddle assembly further includes a first attachment gusset configured to selectively engage any of the first group of plural deck brackets such that the location of the saddle assembly is adjustable along the longitudinal axis of the tower section. A second group of plural deck brackets is also fixed to the railcar deck and longitudinally spaced, and, a second saddle assembly that has a second attachment gusset configured to selectively engage any of the second group of plural deck brackets such that the location of the second saddle assembly is adjustable along the longitudinal axis of the tower section.

In a specific embodiment, the foregoing system further includes a second locating assembly, which includes a second key rail assembly and a second foot stop assembly. The second foot stop assembly is adapted for rigid attachment to a second end of the tower section, and includes a second locating key. The second key rail assembly is adapted for rigid attachment to the railcar deck, and includes a second group of plural key fixtures along its length for selective engagement with the second key set of the second foot stop assembly, to thereby define plural mounting locations along the length of the railcar at which the second foot stop assembly may be located.

The present disclosure teaches a method for transporting a tower sections that have a first end and an elongated portion, and that have various lengths and weight distribution profiles, on a railcar having a deck, using a locating assembly that includes a key rail assembly with plural key fixtures along its length that define plural mounting locations, and a foot stop assembly with a locating key, and a saddle assembly with a saddle that generally conforms to the circumference of the tower section. The method includes the steps of attaching the foot stop assembly to the first end of a tower section, attaching the key rail assembly to the railcar deck, and attaching the saddle assembly to the deck of the railcar at a location along the elongated portion of the tower section. The method further includes resting the elongated portion of the tower section on the saddle of the saddle assembly, and engaging the locating key with a selected one of the plural key fixtures on the key rail assembly, to thereby fixedly located the tower section along the railcar at a selected one of the plural mounting locations.

In a specific embodiment of the foregoing method, where the saddle assembly includes a first attachment gusset, the method further includes attaching plural deck brackets to the railcar deck, which are longitudinally spaced apart, and selectively engaging the first attachment gusset to one of the plural deck brackets such that the location of the saddle assembly is selectively located along the longitudinal axis of the tower section.

In a specific embodiment of the foregoing method, where the key rail assembly includes a first steel rail, and the plural key fixtures are longitudinally spaced transverse slots formed in the steel rail, and wherein the locating key includes a transverse steel bar, the method further includes engaging the transverse steel bar into a selected one of the transverse slots, thereby selectively positioning and retaining the locating key along the key rail.

In a specific embodiment of the foregoing method, where the key rail includes two parallel rails, and where the plural key fixtures are plural longitudinally spaced transverse bars connected between the rails, and where the locating key includes a transverse slot formed in the foot stop, the method further includes engaging the transverse slot onto a selected one of the transverse bars, thereby selectively positioning and retaining the locating key along the key rail.

In a specific embodiment of the foregoing method, where the key rail assembly includes plural holes formed though it, which correspond with the plural mounting locations, and where the foot stop assembly includes a first pin hole, the method further includes inserting a locating pin between the first pin hole and one of the plural holes formed in the key rail assembly, thereby locking the foot stop assembly at one of the plural mounting locations on the key rail assembly.

In a specific embodiment of the foregoing method, where the tower section includes a mount attached to the first end, and where the foot stop assembly includes a recess formed in the top of the foot stop assembly that is shaped to partially conform to the mount, the method further includes engaging the mount in the recess in the top of the foot stop assembly to resist movement of the tower section along the longitudinal axis of the railcar and resist rotation of the tower section about the tower section's longitudinal axis.

BRIEF DESCRIPTION OF THE DRAWINGS

FIG. 5 is a partial perspective view drawing of a railcar with tower section and tower mounting assemblies according to an illustrative embodiment of the present invention.

FIGS. 6A, 6B, and 6C are perspective view drawings of tower foot stops according to illustrative embodiments of the present invention.

DESCRIPTION OF THE INVENTION

Figure 1:
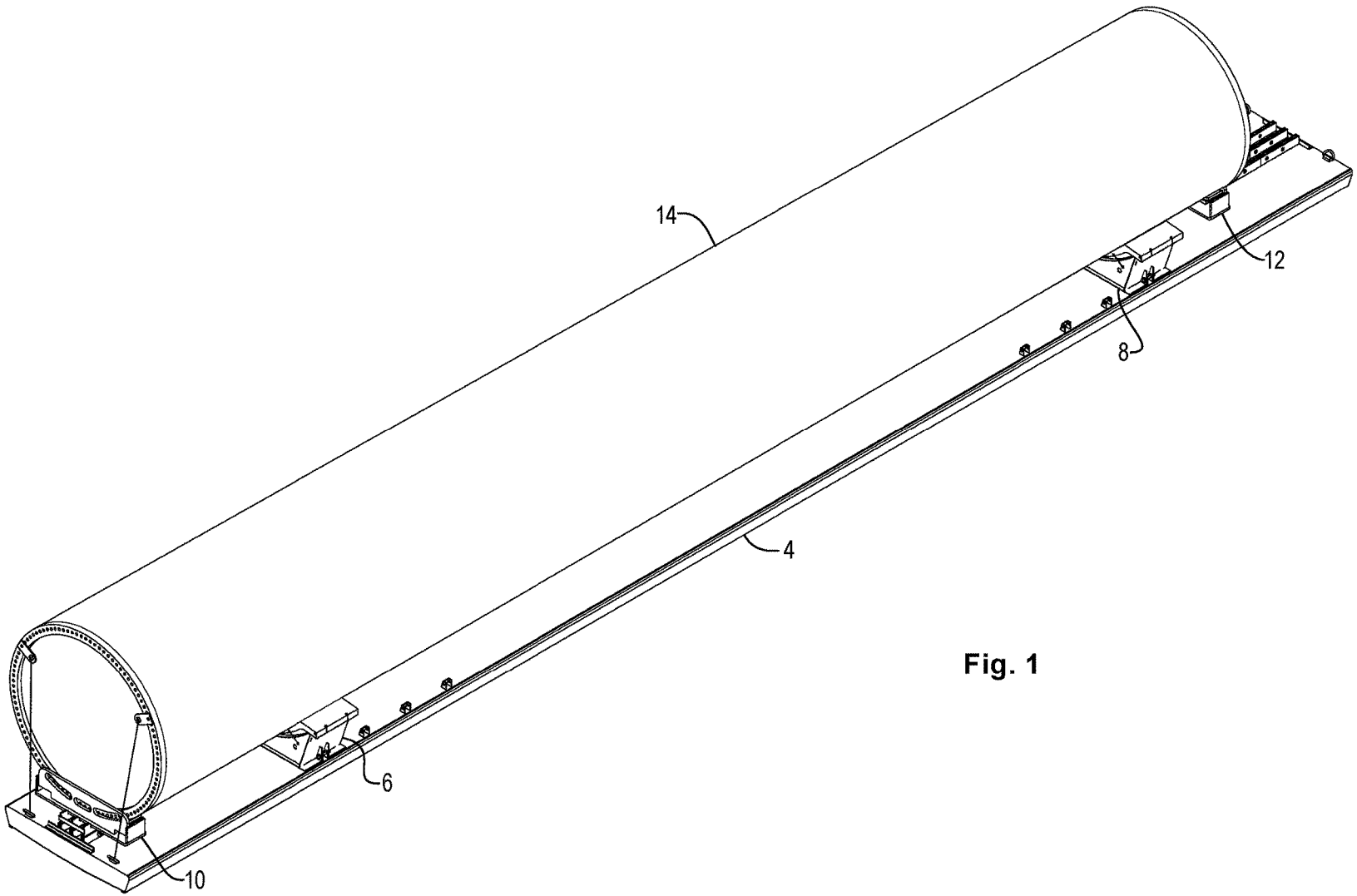
FIG. 1 is a perspective view drawing of a tower section loaded on a railcar according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components, and method steps, have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The teachings herein address the problems in the prior art associated with railroad transportation of large towers and tower sections used in conjunction with commercial wind turbine systems. A variety of innovative mounting fixtures are employed, including tower manufacturer supplied fixtures, fixtures permanently attached to railcars, reusable fixtures, and fixture adaptors that accommodate various tower dimensions. The combination of these fixtures enables manufacturers, railroads, and rail services providers to accommodate virtually any tower configuration using the fewest possible number of fixtures types. Additionally, a greater number of the fixture components are reusable under the teachings of the present disclosure as compared to prior art systems, which substantially reduces costs. Through application of the teachings herein, there is less welding and cutting to and from the railcar decks, which improves utilization of the rolling stock and shortens turn-around time for loads. This is particularly beneficial in the case of 89-foot flatcars, which are often preferred for large tower sections, yet are in decreasing supply, industry wide.

The principles of the present disclosure are embodied in an improved saddle and locator assembly system, which includes a foot stop assembly with a key rail defining plural mounting locations on the railcar, and with movable saddles, which allow the saddles, as well as tower section securing assemblies, to be located and secured at different points along the longitudinal axis of the railcar, as required to support and secure tower sections of various a given lengths and weight distribution profiles. The considerations for loading and securing a tower section on a railcar include the length, position, and weight of the tower section as applied to the railcar, given that the railcar has certain loading restrictions. While it may be preferable to place loads directly over the railcar bolsters, the length and clearance issues may dictate otherwise. The present disclosure enables engineers to configure the saddles and foot stops at optimum positions for any given shipping set-up. Also importantly, the fixtures can be reused and adjusted to accommodate various tower section sizes and railcar loading requirements as may be required from time to time.

Reference is directed to FIG. 1, which is a perspective view drawing of a tower section 14 loaded on a railcar 4 according to an illustrative embodiment of the present invention. As a preliminary matter, it is to be understood that the term "tower" and "tower section" are largely interchangeable in this disclosure. In the case where a single railcar is carrying a single tower or tower section, there is no distinction between the two. The distinction only exists at the time the tower is erected, which occurs after the tower or tower section has been unloaded from the railcar. In the case where a tower assembly comprises plural tower sections, and where all the tower sections are transported using a single train, then the distinction between a tower and a tower section is worth noting, in that there may be coordinated aspects of the loading and unloading of the tower sections.

The tower section 14 in FIG. 1 is located and supported on the railcar 4 using a full complement of fixture assemblies. These fixture assemblies include a first saddles assembly 6, a second saddle assembly 8, a first locating assembly 10, and a second locating assembly 12. Each of these fixture assemblies will be more fully described hereinafter. Note that the primary function of the saddle assemblies 6, 8 is to support the weight of the tower section 14. It is generally preferable to locate the saddle assemblies directly over the railcar bolsters (not shown), as this transfers the weight of the tower more directly to the underlying railroad tracks (not shown) and induces fewer structural stains on the railcar structure. The locating assemblies 10, 12 may carry weight, but they primarily position and retain the tower section 14 against longitudinal movement. The locating assemblies also prevent rotation of the tower section 14 about its longitudinal axis. The locating assemblies sometimes include a tower mount portion that is provided with the tower section by the tower manufacturer, and which are utilized in several modes of transportation, such as be ship and truck. Note that is this disclosure the use of orienting terminology is consistent with that used in the railroad and railcars, such as longitudinal meaning the longitudinal axis of the train, as well as terms such as lateral (side-to-side), and up and down, etc.

Figures 2A, 2B:
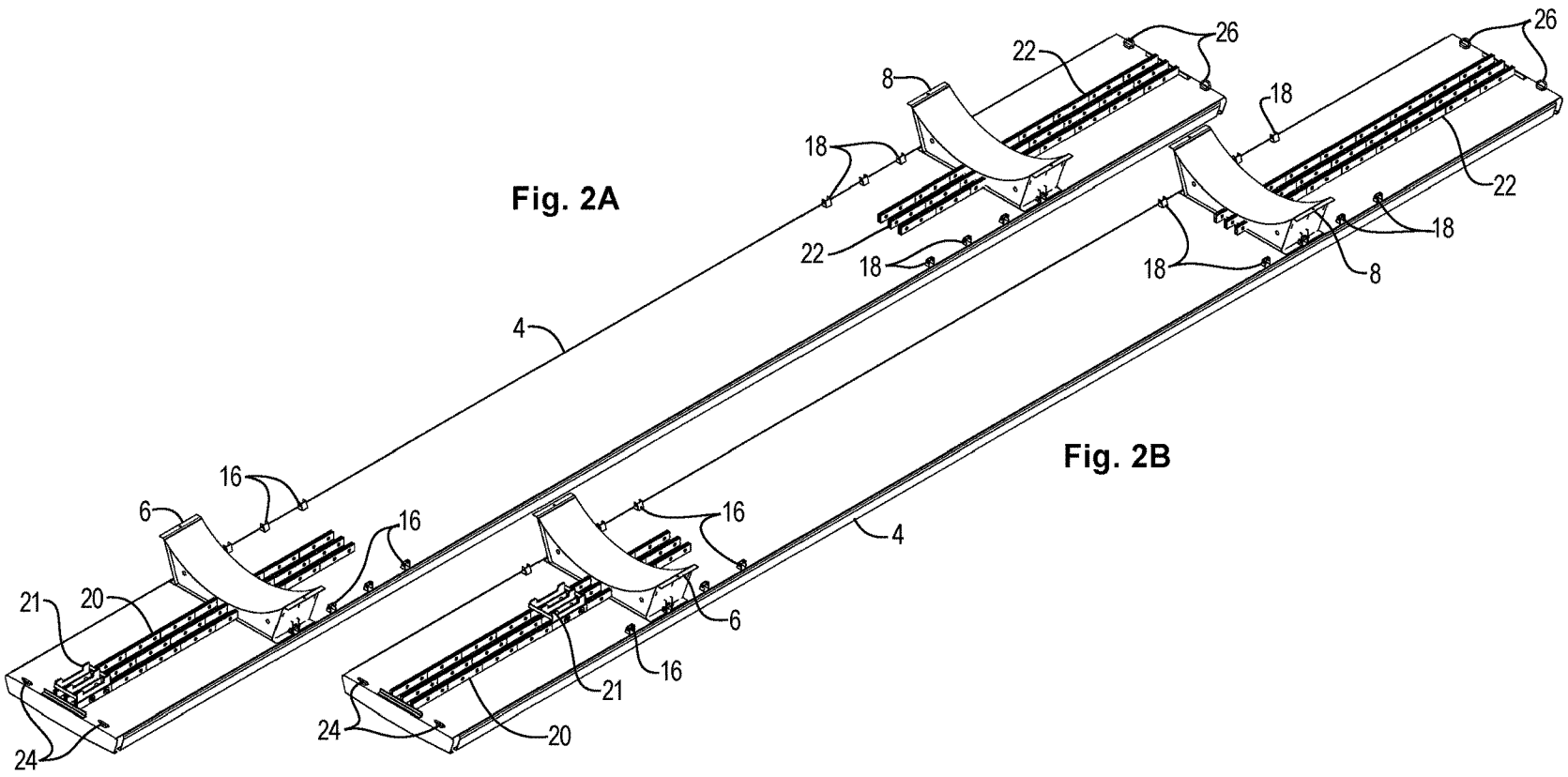
FIGS. 2A and 2B are perspective view drawings railcars with tower mounting assemblies according to illustrative embodiments of the present invention.

Reference is directed to FIGS. 2A and 2B, which are perspective view drawings of a railcar 4 with tower mounting assemblies according to illustrative embodiments of the present invention. FIG. 2A illustrates a preferred arrangement where the saddles assemblies 6, 8 are located over the railcar 4 bolsters (not shown). This arrangement is useful where the tower section (not shown) is approximately the same length as the railcar 4. FIG. 2B illustrates an alternate fixture location arrangement where the saddle assemblies 6, 8 are moved toward the center of the railcar 4 to support a tower section (not shown) that is significantly shorter than the length of the railcar 4. Other components of the saddle assemblies 6, 8 and locating assemblies are presented in these Figures.

The first saddles assembly in FIGS. 2A and 2B comprises the saddle 6 and plural deck brackets 16, as well as other elements that will be more fully described hereinafter. The plural deck brackets 16 are paired from side to side and spaced longitudinally along the railcar, and are used to engage the saddle 6 at the location of each set of paired deck brackets 16. A similar arrangement is provide at the other end of the railcar 4 with the second saddle 8 and its corresponding plural deck brackets 18. Thusly, the position of the saddles 6, 8 are adjustable in position along the length of the railcar 4 using the sets of brackets 16, 18 that are welded to the deck of the railcar 4.

FIGS. 2A and 2B also illustrate a first locating assembly, which is comprised of a key rail 20 welded to the railcar 4, a foot stop 21 and optional D-rings 24. The key rail 20 is comprised of plural steel rails and locating means, which will be more fully discussed hereinafter. Note that the location of the foot stop 21 is changed between FIGS. 2A and 2B, which presents and other adjustability feature of the present disclosure. At the other end of the railcar 4 is a second key rail 22, which is similar to first key rail 20. There is also a pair of optional D-rings 26 at the other end of the railcar 4.

Figure 3:
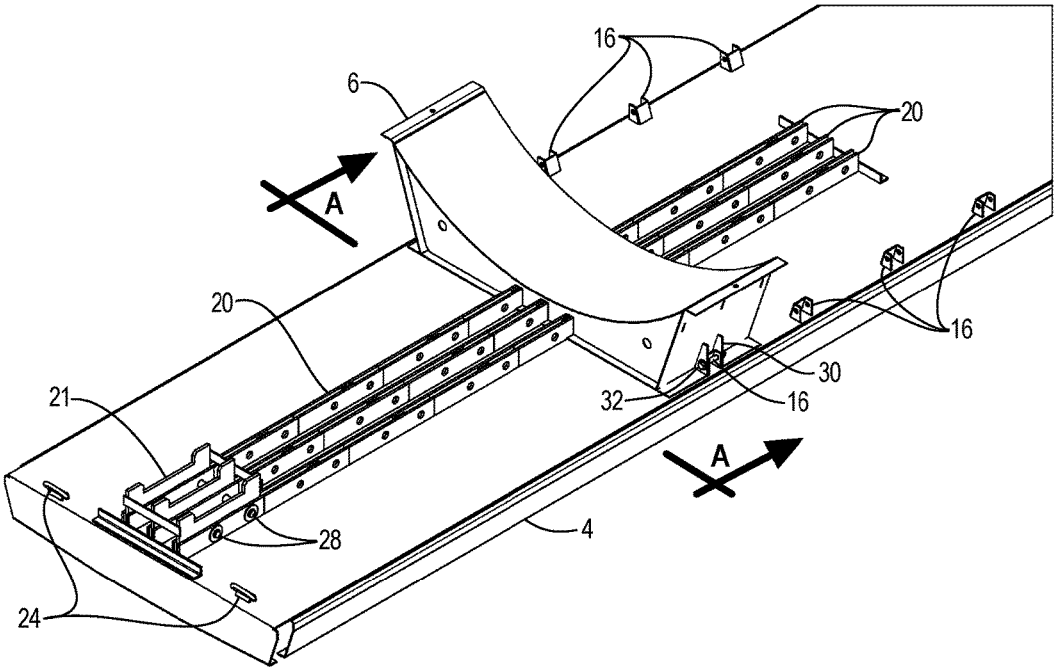
FIG. 3 is a partial perspective view drawing of a railcar with tower mounting assemblies according to an illustrative embodiment of the present invention.

Reference is directed to FIG. 3, which is a partial perspective view drawing of a railcar 4 with tower mounting assemblies according to an illustrative embodiment of the present invention. The saddle 6 includes attachment gussets 30 on either side (only one side is visible) that are configured to engage a corresponding pair of the plural deck brackets 16. The selected connection location is fixed using a bolt or pin 32 disposed between corresponding holes in the attachment gusset 30 and the deck bracket 16, as illustrated.

FIG. 3 also illustrates further components of the locating assembly, including the key rail 20, foot stop 21, and locating pins 28. The key rail 20 defines plural mounting location at which the foot stop 21 may be positioned. In the illustrative embodiment, the key rail 20 is comprised of plural steel rails that are welded to the railcar 4. The structure and purpose of the arrangement will be more fully described hereinafter.

Figure 4:
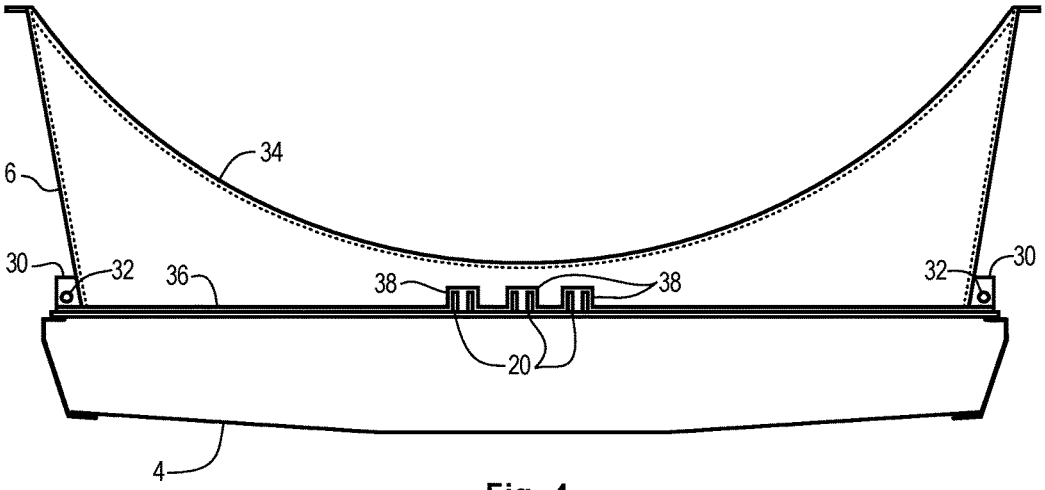
FIG. 4 is a section view drawing of a railcar with a tower saddle assembly according to an illustrative embodiment of the present invention.

Reference is directed to FIG. 4, which is a section view drawing of a railcar 4 with a tower saddle assembly 6 according to an illustrative embodiment of the present invention. This section view A-A is taken from FIG. 3. In FIG. 4, the saddles assembly 6 is shown as well as the arcuate shape of the saddle surface 34. The saddles assembly 6 has a base surface 36 that conforms to the railcar 4. There is a pair of attachment gussets 30 on either r side, which holes 32 for engaging the aforementioned locating pins (not shown). Note that plural slots 38 are formed in the base 36 of the saddles assembly 6 to provided clearance for the key rails 20. This arrangement enables the movement of the saddle assembly 6 to be independent of the key rail 20 configuration.

Reference is directed to FIG. 5, which is a partial perspective view drawing of a railcar 4 with tower section 14 and tower mounting assemblies according to an illustrative embodiment of the present invention. This figure presents further details on how the tower section 4 is fixed to the railcar 4. Note that there is a mounting flange 42 on the end of the tower section 14, which is typical for wind turbine tower sections in general. A pair of mounting tabs 44 are bolted to the flange 42, and steel cable or chain 46 is used to secure the tower 4 to the D-rings 24 that are welded to the railcar 4. The saddle assembly 6, which supports a portion of the weight of the tower section 14, is also visible in this view.

The locating assembly components are further detailed in FIG. 5. Note that this tower section 14 includes a tower mounting bracket 40, referred also as a "mount," which is provided by the tower supplier and is bolted to the end flange 42. The mount 40 engages the foot stop 21, which in turn relocatably engages the key rail 20. Thusly, the factory mount 40 can remain on the tower section 14 as it is moved between transportation modes, yet the foot stop 21 is adapted to engage the mount 40, and is also relocatable along the length of the key rail 20 between the plural mounting locations. This, in conjunction with the movable saddle assembly 6, provides a wide range of loading options to cover a wide range of tower lengths and weight distribution profiles.

Reference is directed to FIGS. 6A, 6B, and 6C, which are perspective view drawings of tower foot stops according to illustrative embodiments of the present invention. The present disclosure teaches a range of foot stop designs to accommodate a wide range of transportation options. Each of these foot stops is interchangeable along a common key rail (not shown). FIG. 6A present a bolt-on flange 50 type of foot stop. The bolt-on flange 50 is attached to plural mounting ribs 56, which each comprise a pair of pin holes 64 and a transverse key slot 62 for engaging a key rail (not shown). This assembly is fabricated from mild steel. FIG. 6B present a recessed flange 52 type of foot stop. The recessed flange 52 is attached to plural mounting ribs 58 that each locate the flange rearward of the mounting location, and which each comprise a pair of pin holes 68 and a transverse key slot 66 for engaging a key rail (not shown). This assembly is also fabricated from mild steel. FIG. 6C present a custom mount 54 type of foot stop. The custom mount 54 is designed to accommodate whatever special mount (not shown) that a supplier might provide from time to time. The custom mount 54 is attached to plural mounting ribs 60, which each comprise a pair of pin holes 72 and a transverse key slot 70 for engaging a key rail (not shown). This assembly is also fabricated from mild steel.

Figure 7:
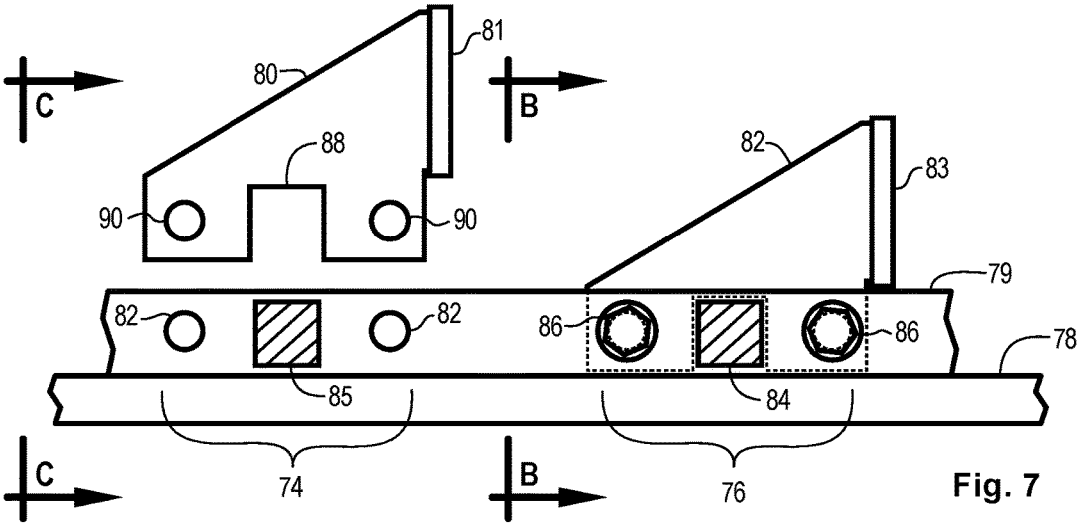
FIG. 7 is a detail drawing of a tower locating assembly according to an illustrative embodiment of the present invention.

Reference is directed to FIG. 7, which is a detail drawing of a tower locating assembly according to an illustrative embodiment of the present invention. The railcar deck 78 provides the foundation for this assembly. The key rail 79 comprises plural steel rails, which are fixed to the deck 78, such as by welding or the use of brackets, as are known to those skilled in the art. Along the length of the key rail 79 are plural mounting locations 74, 76, which are defined by the location of pin holes 82 and key bars 84, 85. The number of mounting locations 74, 76 are controlled by the length of the key rail 79. The first mounting location 74 is illustrated with the foot stop 80 about to be engaged with the key rail 79. The second mounting location 76 is illustrated after a food stop 82 is engaged.

Note in FIG. 7 that the first mounting location 74 foot stop 80 includes a mounting flange 81 for engaging a tower section (not shown), and has pin holes 90 and a transverse key slot 88 for engaging the pin holes 82 and key bar 85, respectively, in the key rail 79. The second mounting location 76 has a foot stop 82 with a mounting flange 83, and is already engaged with the key rail 79. The transverse bar 84 is thusly engaged and a pair of bolts 86, or pins, has fixed the foot stop 82 to the key rail 79 at the second mounting location 76.

Figure 8:
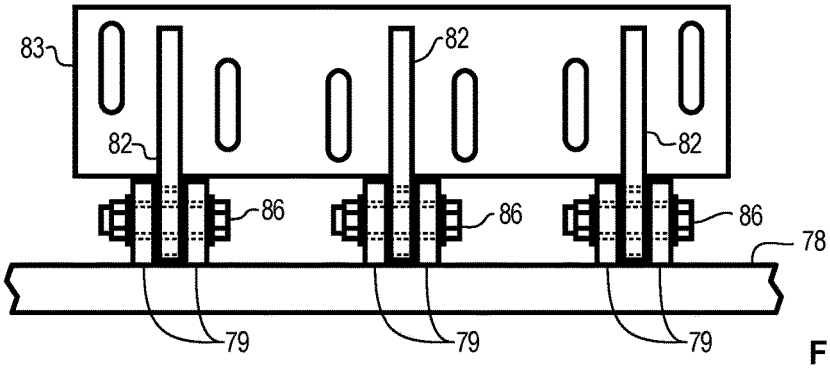
FIG. 8 is a section view drawing of a tower locating assembly according to an illustrative embodiment of the present invention.

Reference is directed to FIG. 8, which is a section view drawing, taken along line B-B in FIG. 7, showing a tower locating assembly according to an illustrative embodiment of the present invention. The railcar deck 78 supports the plural steel rails that comprise the key rail 79. Note that this embodiment employs three pairs of steel rails, but other numbers of rails could be employed. The foot stop 82 ribs are disposed between the pairs of rails 79, and are retained in place by the plural bolt sets 86. This arrangement provides sufficient strength to locate and retain the tower section (not shown) in place against all anticipated dynamic loads during transport.

Figure 9:
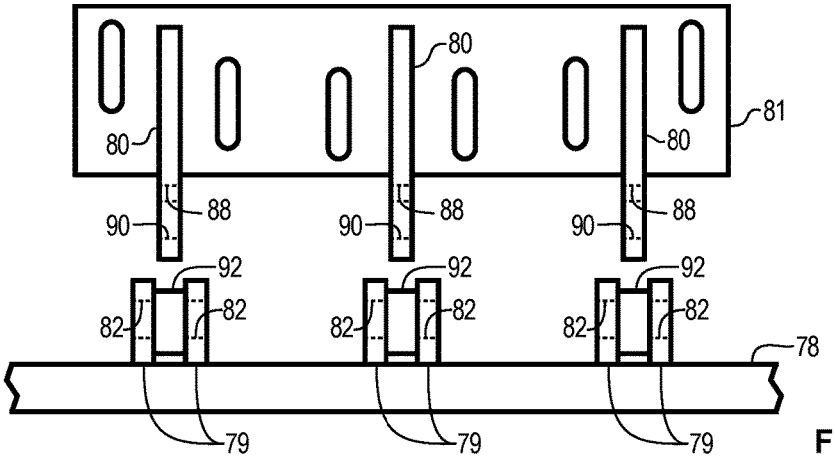
FIG. 9 is a section view drawing of a tower locating assembly according to an illustrative embodiment of the present invention.

Reference is directed to FIG. 9, which is a section view drawing, taken along line C-C in FIG. 7, showing a tower locating assembly according to an illustrative embodiment of the present invention. The railcar deck 78 supports the plural steel bars of the key rail 79. A transverse key bar 92 is disposed between each pair of rails 79. Pin holes 82 are formed through the rails 79. The mounting flange 81 is coupled to the plural ribs 80, each of which comprise a transverse key slot 88 and plural pin holes 90, as illustrated.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A system for transporting tower sections of various lengths and weight profiles on a railcar having a deck, wherein the tower sections have a first end and an elongated portion, the system comprising:

a locating assembly, which includes a key rail assembly and a foot stop assembly, wherein said foot stop assembly includes a locating key and is adapted for rigid attachment to the first end of the tower section, and wherein said key rail assembly is adapted for rigid attachment to the railcar deck, and includes plural key fixtures along its length for selective engagement with said locating key, to thereby define plural mounting locations along the length of the railcar at which said foot stop assembly may be located;

a saddle assembly configured to rest upon the deck of the railcar at a location along the elongated portion of the tower section, and having a saddle that generally conforms to the circumference of the tower section, and wherein said locating assembly and said saddle assembly cooperatively support the tower section above the deck of the railcar.

2. The system of claim 1, further comprising:

plural deck brackets adapted for fixed connection to the railcar deck, and wherein said saddle assembly further comprises at a least a first attachment gusset configured to selectively engage any of said plural deck brackets, and wherein said plural deck brackets are fixedly connected to the railcar deck and longitudinally spaced such that the location of said saddle assembly is adjustable along the longitudinal axis of the tower section.

3. The system of claim 1, and wherein:

said locating key and said plural key fixtures are implemented with cooperative slots and bars.

4. The system of claim 1, and wherein:

said key rail assembly is comprised of at least a first steel rail, and wherein said plural key fixtures are plural longitudinally spaced transverse slots formed in said at least a first steel rail, and wherein said locating key comprises a transverse steel bar sized to retainably engage any of said plural longitudinally spaced transverse slots.

5. The system of claim 1, and wherein:

said key rail assembly is comprised of at least two parallel rails, and wherein said plural key fixtures are plural longitudinally spaced transverse bars connected between said rails, and wherein said locating key comprises a transverse slot formed in said foot stop that is sized to retainably engage any of plural longitudinally spaced transverse bars.

6. The system of claim 1, and wherein:

said key rail assembly comprises plural holes formed therethrough which correspond with said plural mounting locations, and wherein said foot stop assembly comprises at least a first pin hole, and further comprising at least a first locating pin disposed between said at least a first pin hole and at least one of said plural holes formed in said key rail assembly, to thereby lock said foot stop assembly at a selected one of said plural mounting locations on said key rail assembly.

7. The system of claim 1, and wherein said key rail assembly is welded to the deck of the railcar and said foot stop assembly is bolted to the first end of the tower section.

8. The system of claim 1, wherein the tower section includes a mount attached to the first end, and wherein:

said foot stop assembly includes a mount engagement means configured to engage the mount to resist movement along the longitudinal axis of the railcar and resist rotation of the tower section.

9. The system of claim 8 wherein the mount includes a horizontal support surface, and wherein:

said mount engagement means is a recess formed in the top of said foot stop assembly shaped to partially conform to the shape of the horizontal support surface.

10. The system of claim 1, further comprising:

a first group of plural deck brackets fixed to the railcar deck and longitudinally spaced, and wherein said saddle assembly comprises a first attachment gusset configured to selectively engage any of said first group of plural deck brackets such that the location of said saddle assembly is adjustable along the longitudinal axis of the tower section;

a second group of plural deck brackets fixed to the railcar deck and longitudinally spaced;

a second saddle assembly having a second attachment gusset configured to selectively engage any of said second group of plural deck brackets such that the location of said second saddle assembly is adjustable along the longitudinal axis of the tower section.

11. The system of claim 1, further comprising:

a second locating assembly, including a second key rail assembly and a second foot stop assembly, wherein said second foot stop assembly is adapted for rigid attachment to a second end of the tower section, and includes a second locating key;

said second key rail assembly is adapted for rigid attachment to the railcar deck, and includes a second group of plural key fixtures along its length for selective engagement with said second key set of said second foot stop assembly, to thereby define plural mounting locations along the length of the railcar at which said second foot stop assembly may be located.

12. A method for transporting a tower sections that have a first end and an elongated portion, and that have various lengths and weight distribution profiles, on a railcar having a deck, using a locating assembly that includes a key rail assembly with plural key fixtures along its length that define plural mounting locations, and a foot stop assembly with a locating key, the foot stop assembly being adapted for rigid attachment to the first end of the tower section, and a saddle assembly with a saddle that generally conforms to the circumference of the tower section, the method comprising the steps of:

attaching the foot stop assembly to the first end of a tower section;

attaching the key rail assembly to the railcar deck;

attaching the saddle assembly to the deck of the railcar at a location along the elongated portion of the tower section;

resting the elongated portion of the tower section on the saddle of the saddle assembly, and engaging the locating key with a selected one of the plural key fixtures on the key rail assembly, to thereby fixedly located the tower section along the railcar at a selected one of the plural mounting locations, and thereby cooperatively supporting the tower section by the saddle assembly and the foot stop assembly.

13. The method of claim 12, wherein the saddle assembly includes at a least a first attachment gusset, and further comprising the steps of:

attaching plural deck brackets to the railcar deck, which are longitudinally spaced apart, and selectively engaging the first attachment gusset to a selected one of the plural deck brackets such that the location of the saddle assembly is selectively located along the longitudinal axis of the tower section.

14. The method of claim 12, and wherein the key rail assembly includes a first steel rail, and the plural key fixtures are longitudinally spaced transverse slots formed in the steel rail, and wherein the locating key includes a transverse steel bar, and further comprising the step of:

retainably engaging the transverse steel bar into a selected one of the transverse slots, thereby selectively positioning the locating key along the key rail.

15. The method of claim 12, and wherein the key rail includes two parallel rails, and wherein the plural key fixtures are plural longitudinally spaced transverse bars connected between the rails, and wherein the locating key includes a transverse slot formed in the foot stop, and further comprising the steps of:

retainably engaging the transverse slot onto a selected one of the transverse bars, thereby selectively positioning the locating key along the key rail.

16. The method of claim 12, and wherein the key rail assembly includes plural holes formed therethrough, which correspond with the plural mounting locations, and wherein the foot stop assembly includes a first pin hole, and further comprising the steps of:

inserting a locating pin between the first pin hole and a selected one of the plural holes formed in the key rail assembly, to thereby lock the foot stop assembly at a selected one of the plural mounting locations on said key rail assembly.

17. The method of claim 12, wherein the tower section includes a mount attached to the first end, and wherein the foot stop assembly includes a recess formed in the top of the foot stop assembly that is shaped to partially conform to the mount, and further comprising the step of:

engaging the mount in the recess in the top of the foot stop assembly to thereby resist movement of the tower section along the longitudinal axis of the railcar and resist rotation of the tower section about the tower section's longitudinal axis.

* * * * *